US005369851A

United States Patent [19]

Merkel

[11] Patent Number: 5,369,851

[45] Date of Patent: Dec. 6, 1994

[54] CLAMP FOR CONNECTING THE SECTIONS AT THE EDGES OF FORMWORK PANELS

[75] Inventor: Josef Merkel, Welschensteinach, Germany

[73] Assignee: Paschal-Werk G. Maier GmbH, Steinach, Germany

[21] Appl. No.: 116,248

[22] Filed: Sep. 2, 1993

[30] Foreign Application Priority Data

Oct. 26, 1992 [DE] Germany ..... 4236070

[51] Int. Cl.[5] ..... E04G 17/00

[52] U.S. Cl. ..... 24/136 R; 24/132 WL; 24/495; 248/231.3

[58] Field of Search ..... 24/136 R, 132 WL, 495, 24/483, 514, 525, 535, 492; 248/231.3, 231.5; 269/223, 237, 229, 239

[56] References Cited

U.S. PATENT DOCUMENTS

| | | | |
|---|---|---|---|
| 482,975 | 9/1892 | Cope | 24/136 R |
| 552,501 | 12/1895 | Snively | 24/132 WL |
| 2,896,895 | 7/1959 | Speese | 248/231.3 |
| 4,493,495 | 1/1985 | Linn | 24/535 |
| 4,592,116 | 6/1986 | Christensen | 24/136 R |
| 4,716,811 | 1/1988 | Johnson | 24/495 |

*Primary Examiner*—Victor N. Sakran
*Attorney, Agent, or Firm*—Darby & Darby

[57] ABSTRACT

A clamp (1) serves for formwork panels (2) arranged in-plane, side by side, to be connected at the webs (3) running round their edges and has for this purpose two clamping jaws (4) which urge these edge webs (3) together and can be swivelled relative to each other and to a mount (8) with the aid of a wedge (7), the mount simultaneously constituting the abutment for the wedge (7). The clamping jaws have for this purpose points (6) of application for the wedge face (7*c*) averted from face (7*b*), which points of application (6) are spaced from the swivel bearings (5) of the clamping jaws (4) and are under a lever arm. These points of application (6) are suitably arranged at the inner end of an elongated and guiding slot (10) which is open towards the opposite side and also affords lateral guidance for the wedge as it moves. The direction in which the wedge extends and moves is crosswise to the extent of the swivelling axes of the swivel bearings (5) with which the clamping jaws (4) are swivel-mounted on the common mount (8). (FIG. 2)

16 Claims, 4 Drawing Sheets

Figure 1:
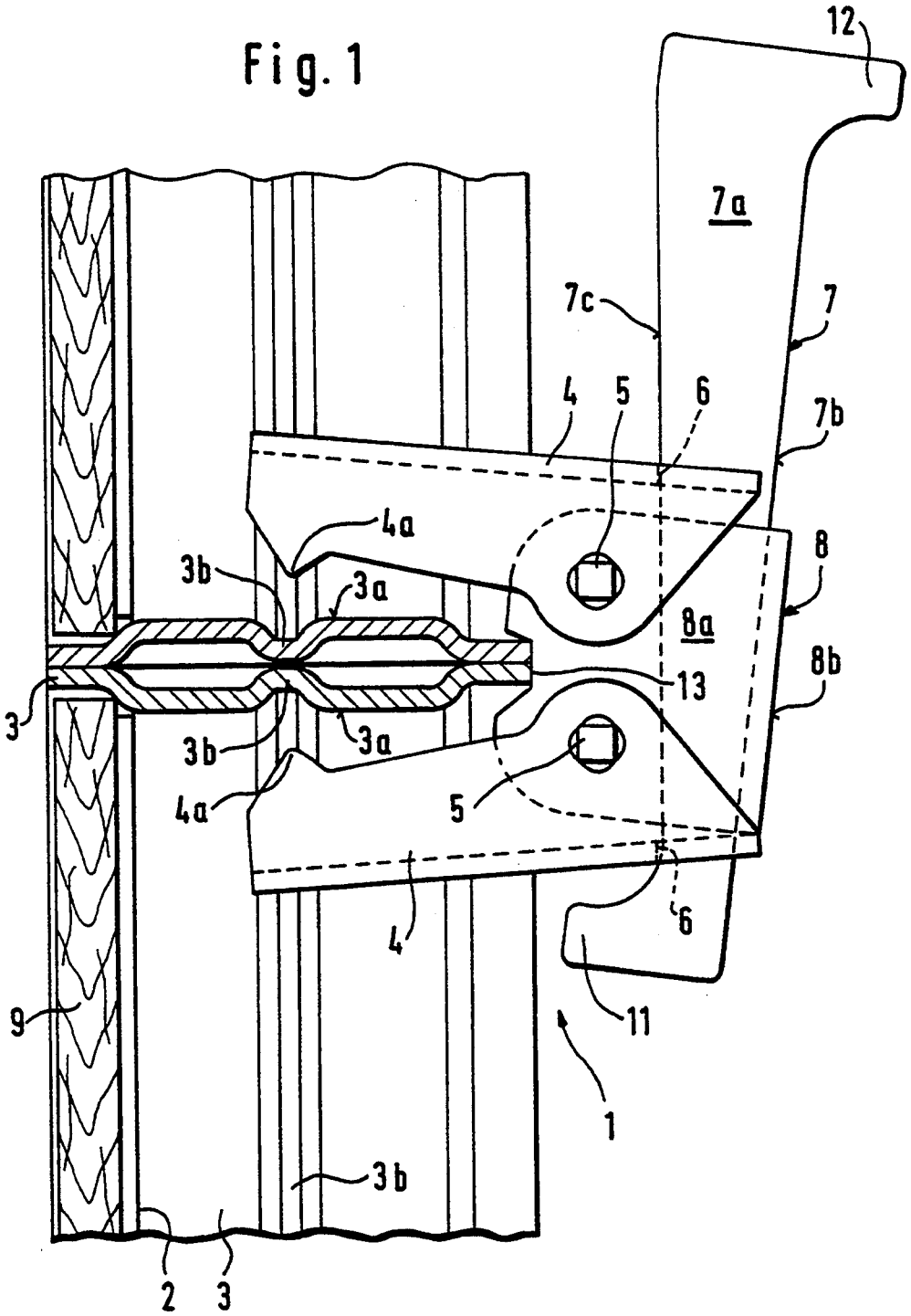

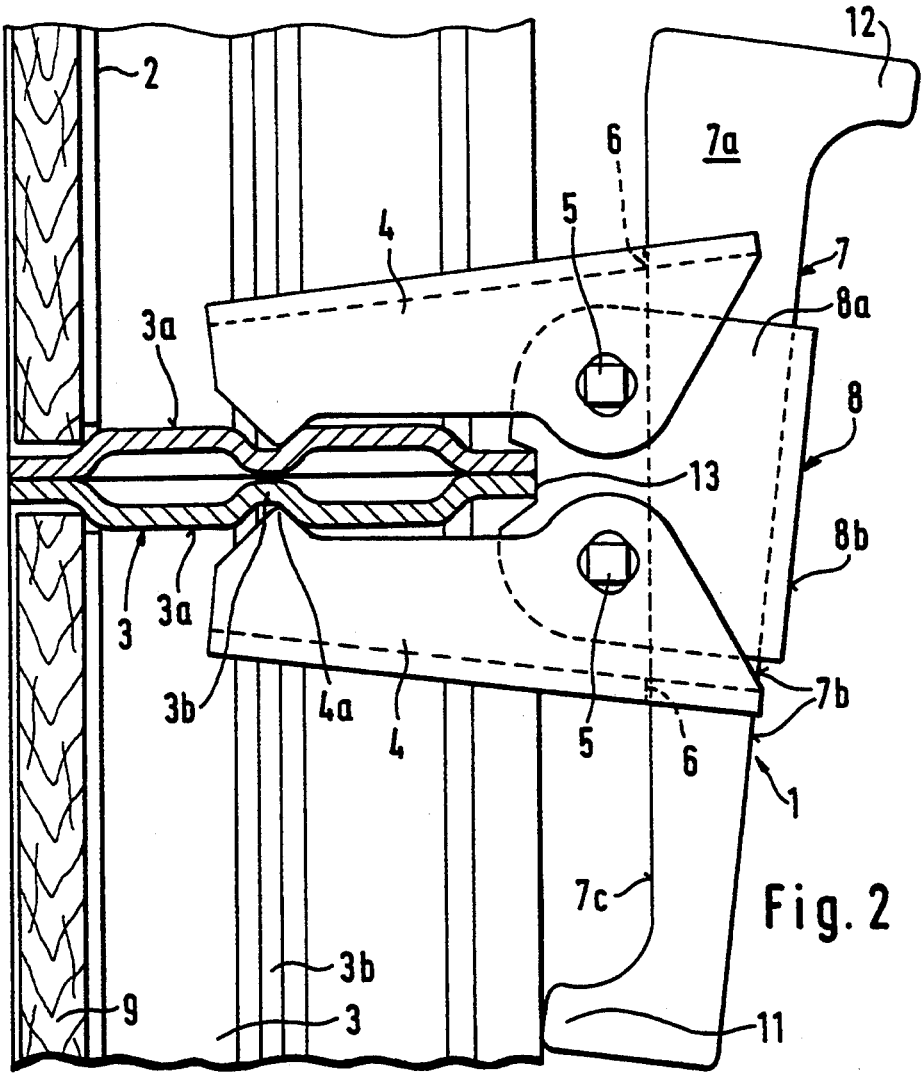
Fig. 2
Fig. 3
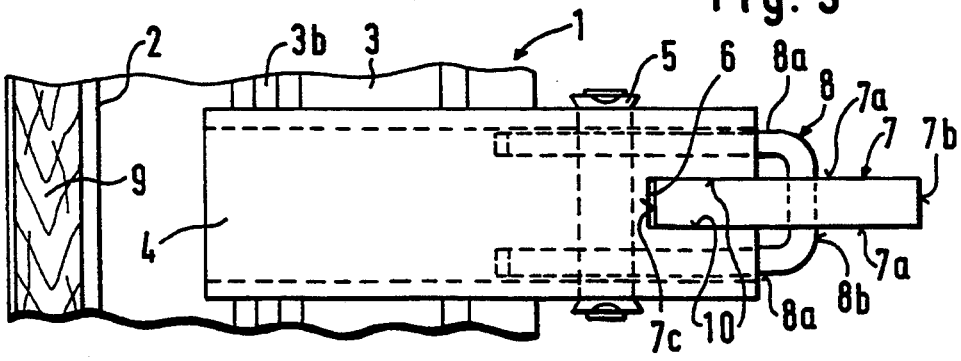

CLAMP FOR CONNECTING THE SECTIONS AT THE EDGES OF FORMWORK PANELS

The invention relates to a clamp for connecting formwork panels which are arranged in-plane, side by side, and have webs or sections running round their edges, the clamp including two clamping jaws which are adapted to be swivelled towards and urge together the longitudinal faces averted from each other of the abutting edge webs or the like, and further including an actuating element for swivelling these clamping jaws, the two clamping jaws each having located at their end averted from their clamping point and arranged in spaced relationship to their swivel bearing a point of application for the actuating element, and the actuating element being supported on a mount belonging to the clamp, on which the two clamping jaws are swivel-mounted.

Such a clamp is known from German Utility Model No. 88 14 208 and has proved to be useful particularly for edge sections in the form of hollow ones of relatively large cross section. It is then necessary, however, that the two clamping jaws are approximately L-shaped and have adjusting arms directed towards and overlapping each other, in order that in the region where the two adjusting arms overlap both can be jointly engaged by an eccentric whose pivot or swivel bearing also has to be movable perpendicular to the forming surface. It is true that this provides for simple manipulability, because a turn of the eccentric effects the bracing wanted. However, particularly the requirement that both clamping jaws overlap each other at their adjusting arms entails a need for corresponding space or restricts the potentially selectable cross sections of material, particularly in the loaded area.

In a clamp of a different kind, according to DE-27 59 966 C2, the clamping jaws or arms are not swivel-mounted on a support, but are movable relative to each other with the aid of overlapping adjusting arms, the latter being jointly traversed by a wedge, so that by driving in the wedge the two adjusting arms and thereby also the clamping arms can be drawn together and braced. The wedge has to be arranged with its breadth approximately parallel to the forming surface, while its working wedge faces opposite and at an angle to each other are at approximately right angles to the forming surface, and the moving direction of the wedge is again directed parallel to the forming surface. This has the result that, as the wedge is driven in, the adjusting arms are not only moved relative to each other but at the same time may also be pressed one against the other, so that the frictional force encountered is liable to be increased in such a way that at least part of the clamping force may thereby be used up.

A clamping device for edge sections of adjacent formwork panels is known from DE-35 17 307 A1, in which swivel-mounted on a support having a fixed clamping jaw as a stop there is a second clamping jaw, whereby the swivelling can be effected with the aid of a threaded piece movable approximately at right angles to the forming surface and can be transferred by way of an L-limb. Therefore different movements result at the mutually opposed clamping jaws and the selected transmission to a swivel member with the aid of a screw spindle performing rectilinear movements requires additional measures.

Therefore the object underlying the invention is to provide a clamp of the kind mentioned at the outset, wherein the advantages of two clamping jaws adapted to swivel relative to each other and to a mount are maintained, but nevertheless a simple actuating element needing no pivot bearings can be used.

This object is accomplished in that the actuating element is a wedge which is arranged with its large face in the swivelling plane and is supported with the one small face against the mount side facing the forming surface and is supported with the other wedge face against the points of application of the clamping jaws, the former being arranged in spaced relationship to the swivel bearings, that the points of application of the two clamping jaws are in each case arranged on sides averted from each other, and in both end positions of the wedge the latter projects beyond both clamping jaws at their points of application.

Hence a very simple actuating element proven in formwork is provided, namely a wedge, but it is avoided that the wedge traverses overlapping parts, so that the parts to be moved towards each other are pressed one against the other through the component oriented in the direction in which the wedge is driven in. Rathermore, the wedge faces can act directly on the points of application, without the parts thereby to be swivelled contacting each other and rubbing against each other. It follows that the wedge is arranged with its breadth in a plane approximately at right angles to the forming surface, as a rule a horizontal one, while the two working wedge faces at an angle to each other are in vertical planes, one of which may run parallel to the forming surface, while the other is at the wedge angle thereto. Very simple handling results, because the wedge can be driven in the one direction and by this means both clamping jaws are swivelled relative to their mount, while they are loosened and released by an opposite movement of the wedge.

It is particularly advantageous if the mount is a hollow section and has at least one limb which is arranged parallel to the swivelling plane and serves to accommodate the swivel bearing of the clamping jaws, as well as a crossbar which is spaced away from the forming surface and serves as an abutment for the wedge. It is particularly advantageous if the support is of angular or even U-shaped configuration and the one angle side or the crossbar of the U forms the abutment of the wedge. The other angle side or U-limbs can point with their free edges to the forming surface in the position of use, so that the actuating wedge is then situated between the swivel bearings and the abutment, the actuating points of the clamping jaws also projecting into that interspace.

The points at which the wedge is applied to the clamping jaws are hence closer to the abutment than the swivel bearings are.

The clamping jaws may for their part have an angular or approximately U-shaped cross section and lap over the mount in the region of their swivel bearing, particularly externally, or may be externally embraced by the mount of U-shaped cross section. This produces a compact and stable design in which the forces arising can be introduced largely symmetrically.

Good introduction of force accompanied by simple guidance of the wedge can be attained if in the region of the points of application of the wedge the clamping jaws extend lengthwise so as to pass beyond their swivel bearings, and preferably have open-ended, elongated slots partly embracing the wedge and small side thereof engaging the slots. Hence the cross section of the wedge can engage with these elongated slots and project from them so far that contact to the abutment is established, but in this way the wedge is engaged not only at its small faces but also over part of its breadth and is guided correspondingly well.

It is suitable if the elongated slots embracing the wedge have a width slightly exceeding the thickness of the wedge and form a lateral guide of the wedge, engaging both large faces of the wedge.

The guide slot may be of the same length at both clamping jaws and the clamping jaws may be arranged at different angles relative to a cross-sectional plane disposed at right angles to the mount and its crossbar, or the crossbar of the mount may be situated relative to the forming surface at the angle at about which the two tapering, working faces of the wedge are arranged to each other. In this way one can allow for the fact that, due to its wedge shape, the wedge simultaneously engaging both clamping jaws is applied to the one clamping jaw with a narrower area than to the other clamping jaw. On the other hand, it would also be conceivable for the length of the slots to be adapted to these different widths of the wedge.

The wedge may have at least at its tapering, narrower end a projection which protrudes beyond the wedge face and serves as a stop preventing the wedge from being removed from the clamp. In this way the wedge becomes captive and furthermore in this way its narrow end also becomes widened for improved application of a tool, for example a hammer, to move the wedge into its release position.

Arranged at the wider end of the wedge there may also be a projection jutting out transversely of the direction in which the wedge extends, particularly a projection averted from the forming surface. This also facilitates and improves driving in of the wedge. Furthermore, a striking tool or the like can be applied to this projection for releasing the wedge, if the narrower end of the wedge is inaccessible, e.g. due to it being too close to stiffening webs or the like.

A development of the invention of great advantage, enabling the forces exerted on the wedge to be introduced more effectively for closing the clamp, may consist in that the small wedge face—which is located at the wider wedge end and is arranged crosswise to the longitudinal expanse of the wedge and crosswise to the direction in which the wedge moves as the clamp is braced—runs slantwise in such a way that an acute angle is formed between said small face and the one small wedge face averted from the swivel bearings. The inclination of the small face and angle thereof to the one small face of the wedge may be selected in such a way that a perpendicular through this slope intersects the space between the two clamping jaws, namely as far as possible in the release position, as the wedge is being driven in and/or also in the closed position of the clamp. As driving in of the wedge progresses, so of course this perpendicular line travels from the outer opening of the interspace towards the rear limit.

Through the slope mentioned, the striking forces applied as the wedge is driven in are introduced into the clamp in a more effective and better way through the wedge. The slanting striking surface at the wider end of the wedge leads to a greater force component approximately in the direction in which the clamping jaws extend, so that the respective clamping jaw spaced from its swivel bearing can be swivelled about its swivelling axis in the closing direction all the quicker and with increased force. This takes place concurrently at both clamping jaws.

Therefore no longer is only the increasing widening of the wedge used for swivelling the clamping jaws more and more, but part of the striking force is directly translated into a swivel movement of the clamping jaws. The other force component in the longitudinal direction of the wedge simultaneously effects the necessary and wanted driving in movement of the wedge. Tests have shown that such an arrangement enables the wedge to be driven in a considerably smoother and vibration-free fashion and allows the clamping jaws to be braced correspondingly effectively, without the striking forces leading to undesired elastic deformations of the formwork panels at the edge webs to be clamped.

It is suitable if the slanting small face continues to the end of the projection provided at the wider end of the wedge. The user is provided with a correspondingly large striking surface inclined relative to the driving in direction, forming a good target to hit.

A further development of the invention, potentially facilitating release of the clamp, may consist in that at the narrower end of the wedge, the wedge has a small face which is arranged at least in part at an obtuse angle to the one small face averted from the swivel bearings of the clamp and serves as an impact surface for a striking tool during release. Hence the shorter end face of the wedge may also be arranged slantwise in an opposite way to the longer end face, in order again to attain an enhanced distribution of the force components as this face is struck. Therefore release of the wedge can also be simplified because a considerable share of the striking force expended is translated into a direct swivel movement of the clamping jaws.

The angle of inclination of the narrower end face of the wedge may be selected in such a way that when the clamp is closed a perpendicular on this slanting face is directly approximately to the clamping zone of the clamping jaws. This measure, which finds its equivalent at the wider end face of the wedge through a corresponding angle of inclination, has proved to be a good compromise for on the one hand swivelling the clamping jaws as directly as possible, but on the other hand for wedging or freeing the wedge without causing vibrations through the reaction forces—also at the edge webs to be clamped of the formwork panels. It has proved that even a short blow may be sufficient on the one hand to fasten the wedge and on the other hand to release it, because the clamp arrangement has no inherent resilience.

Altogether a clamp ensues, all the component parts of which are captivated, so that handling and also storage are very simple. Through the approximately horizontal arrangement of the wedge in the position of use, it is also possible for the clamp embodying the invention to be fitted very close to the upper or lower edge of formwork, without it contacting surfaces proud of the formwork, such as the ground at the lower edge of the formwork.

Two embodiments of the invention with principal features of the same will be described in further detail below with reference to the drawings in which, partly in schematized form.

Figure 4:
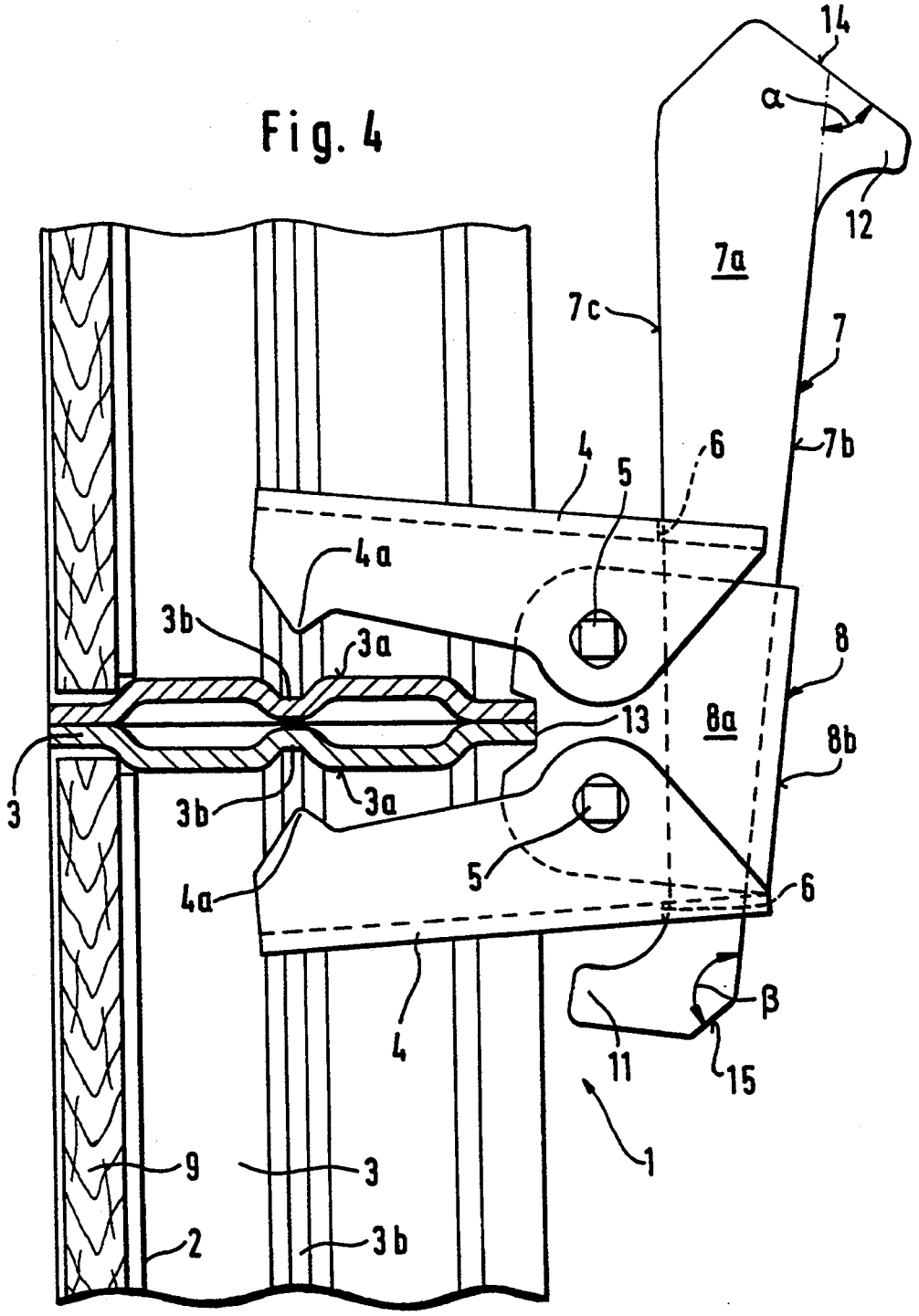
Figure 5:
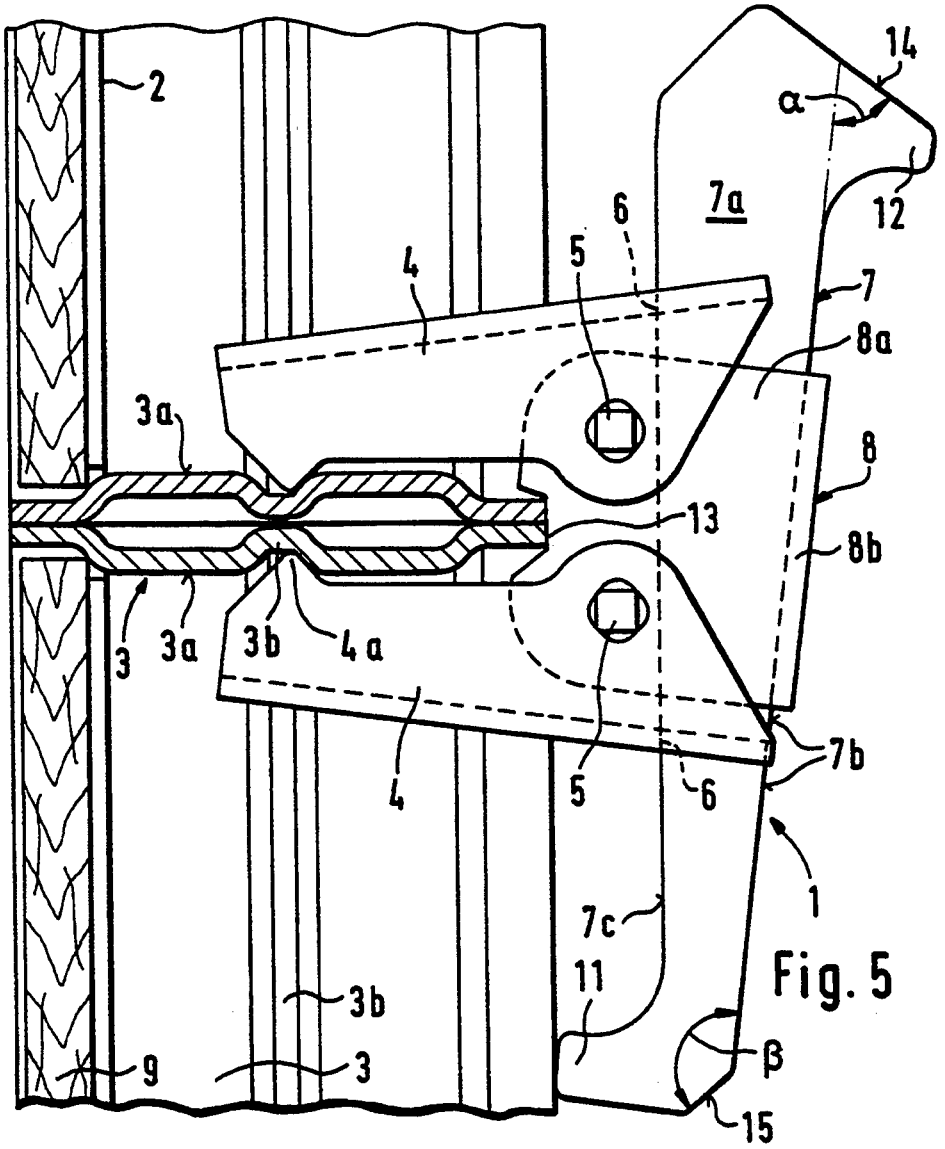
Figure 6:
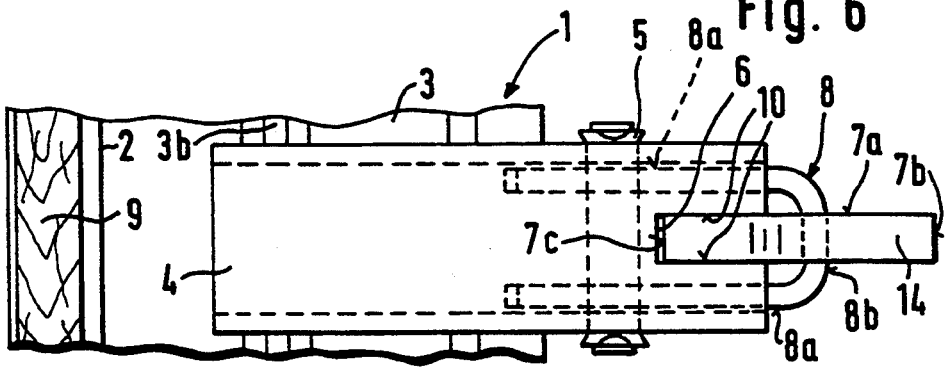

FIG. 1 is a top view of a clamp according to the invention, the clamp being in an open position and applied to two abutting edge webs of adjacent formwork panels, wherein the free edges of the webs are supported against or are up against the mount of the clamp, FIG. 2 is a top view corresponding to FIG. 1 of the clamp in the closed position, FIG. 3 is a side view of the clamp according to the invention in the position of use, FIG. 4 is a top view corresponding to FIG. 1 of an opened clamp with a wedge, in contradistinction to the first embodiment the end striking surfaces of the wedge being arranged at a slant, FIG. 5 is a top view corresponding to FIG. 4 of the clamp in the closed position and FIG. 6 is a side view of the clamp according to FIGS. 4 and 5 in the position of use.

A clamp, generally designated by the reference numeral 1, serves for connecting formwork panels 2 which are arranged in-plane, side by side, and have running round their edges webs 3 or sections to which, in the position of use, the clamp 1 according to FIGS. 2 and 3 is applied for urging together these contacting edge webs 3.

The clamp has for this purpose two gripping or clamping jaws 4 adapted to swivel towards and urge together the longitudinal faces 3*a* averted from each other and grooves 3*b* provided there of the abutting edge sections 3, and further has an actuating element, yet to be described, for this swivelling and bracing of these clamping jaws 4.

The exemplified embodiment shows that the two clamping jaws 4 each have a point of application 6 for the actuating element, in the exemplified embodiment the latter being a wedge 7, said point of application 6 being located at their end averted from their clamping point or clamping projection 4*a* engageable with the groove 3*b* and being arranged in spaced relationship to their swivel bearing 5. This actuating element, hence wedge 7, is supported on a mount 8 belonging to the clamp 1, support being provided in such a way as to permit clamping force to be applied, transferred and maintained thereby.

As already mentioned, the actuating element for this purpose is a wedge 7 which is arranged with its large face 7*a* in the swivelling plane, hence at right angles to the swivelling axes 5, and is supported with the one small face 7*b* against the mount 8 side facing the forming surface 9 of the formwork panels 2 and is supported with the other wedge face 7*c* against the points of application 6 of the clamping jaws 4, the former being arranged in spaced relationship to the swivel bearings 5. The points of application 6 of the two clamping jaws 4 are in each case arranged on sides of the swivel bearings 5 averted from each other, with a lever arm sufficient to lead to the clamping points 4*a* on the clamping jaws 4 swivelling towards each other as the wedge is moved from the position illustrated in FIG. 1 into the position shown in FIG. 2. In both end positions the wedge 7 projects beyond both clamping jaws 4 at their points of application 6, so that both clamping jaws 4 do not fail to be swivelled relative to the mount 8 through the movement of the wedge 7.

Particularly FIG. 3 shows that the mount 8 is a hollow section and has at least one limb 8*a* which is arranged parallel to the swivelling plane and serves to accommodate the swivel bearing 5 of the clamping jaws 4, as well as a crossbar 8*b* which is spaced away from the forming surface 9 and serves as an abutment for the wedge 7 and wedge face 7*b* thereof. The mount could be angular, but in the embodiment is particularly suitably of U-shaped configuration and the crossbar 8*b* of the U forms the abutment already mentioned for the wedge, while the two other limbs 8*a* are traversed by the swivelling axis 5 in the form of a pin or bolt. Since the conceived line connecting the points of application 6 is closer to the abutment, hence crossbar 8*b*, than a line connecting the swivel bearings 5 of the clamping jaws 4 is, and the points of application 6 have a different spacing, in the embodiment a greater one, than the two swivel bearings 5, inserting the wedge 7 from its position illustrated in FIG. 1 into the position of FIG. 2 leads to the clamping jaws 4 swivelling relative to the mount 8 and to each other.

It further follows from FIGS. 1 and 2 on the one hand and FIG. 3 on the other hand that the clamping jaws 4 for their part have an approximately U-shaped cross section and externally lap over the mount 8 in the region of their swivel bearing 5. Conversely it would also be possible though that the clamping jaws 4 are externally embraced by the mount 8 of U-shaped cross section.

In the region of the points of application 6 of the wedge 7 the clamping jaws 4 extend lengthwise so as to pass beyond their swivel bearings 5 and, according to FIG. 1, in the open position one of the clamping jaws can even project beyond the mount 8. According to FIG. 3, the clamping jaws 4 each have in this area an open-ended, elongated slot 10 embracing the wedge 7 and the small face 7*c* thereof engaging the slot. It is apparent in the light of FIG. 3 that by this means the wedge partly comes to rest in, and is guided by, this elongated slot 10, particularly at its large face 7*a*. This is promoted in that the elongated slots 10 embracing the wedge 7 have a width slightly exceeding the thickness of the wedge and therefore form the lateral guide mentioned of the wedge 7 at two spaced locations, therefore guiding and locating the wedge well. On the other hand, by this means the clamping jaws 4 are also fixed better relative to the wedge and locked with the mount 8.

In the exemplified embodiment the guide slot or elongated slot 10 is of the same length at both clamping jaws 4—despite the wedge differing in breadth in the region of each slot—and the clamping jaws 4 are therefore arranged at different angles relative to a cross-sectional plane disposed at right angles to the mount 8 and its crossbar 8*b*—and at an acute angle relative to the large faces of the edge webs 3—or in the position of use the crossbar 8*b* of the mount 8 is situated relative to the forming surface 9 at the angle at about which the two tapering, working faces of the wedge 7 are arranged to each other. It becomes clear particularly in the light of FIG. 2 that given an approximately symmetrical application of the two clamping jaws 4 to the edge webs 3 in the position of use, the mount 8 with its crossbar 8*b* runs slightly at a slant and thereby allows for the wedge taper.

The wedge 7 has at its tapering, narrower end a projection which protrudes beyond the wedge face 7*c* and serves as a stop 11 preventing the wedge from being removed from the clamp 1. In addition, this signifies that the end of the wedge is widened, making it easy for this location to be hammered for release.

The exemplified embodiment also shows that arranged at the wider end of the wedge 7 there is also a projection 12 jutting out transversely of the direction in which the wedge extends, in the embodiment the projection being oriented towards the side averted from the forming surface 9, whereas the stop 11 points in an opposite direction towards the forming surface 9. This projection 12 provides the wedge with an enlargement of its end face, upon which hammer blows can be exerted to increase the gripping power. In addition, this arrangement of the projection 12 allows its opposite side to be acted upon or hammered to release the wedge.

Altogether, for vertical edge webs, the wedge 7 and its large faces *7a* are arranged horizontally, enabling the clamp also to be fixed very close to obstacles running at right angles to the edge webs to be connected, e.g. near the ground the ground itself or brackets or the like attached to the formwork, without the wedge as such and its actuation and movement being inconvenient. Even if the clamp 1 is arranged directly above the base of formwork, the wedge can be driven in without any difficulty, this not being possible at such a location if, for bracing, the wedge were one having to be driven in vertically.

FIGS. 1 and 2 also show that, between the swivel bearings 5, the mount 8 has at its side facing the forming surface 9 an abutment and locating face 13, which can also be termed as a stop face and in the position of use lies against the edges of the edge webs 3 or sections gripped by the clamp 1. The dimensions are selected in such a way that in the clamped position a pulling force towards this locating face 13 is produced by the clamping projections *4a* through grooves *3b*, so that any slight, initial displacements of the edge webs 3 can be levelled out by bracing.

Altogether a clamp 1 ensues which is simple to handle, is nevertheless efficient and consists of a few simple component parts which, however, are interconnected in such a way as to be captive and hence do not have to be assembled for bracing edge webs 3.

The above-mentioned advantages are also realized in the exemplified embodiment according to FIGS. 4 to 6, there being tallying parts to which therefore the same reference numerals have been assigned.

Unlike the first embodiment, however, in the present embodiment of FIGS. 4 to 6 it contemplated that the small face 14—which is located at the wider wedge end presenting projection 12 and is arranged crosswise to the longitudinal expanse of the wedge and crosswise to the direction in which the wedge 7 moves as the clamp 1 is braced—runs slantwise in part, namely in an area averted from the formwork panel 2, in such a way that an acute angle $\alpha$ is formed between said small face and the one small wedge face *7b* averted from the swivel bearings 5. An imaginary extension of small face *7b* up to the point of intersection with the slanting small face 14 is entered into FIG. 4 to illustrate this angle $\alpha$.

This angle $\alpha$ and the inclination of small face 14 is selected in such a way that a perpendicular on this slope 14, and extension of the perpendicular through the slope, intersects the space between the two clamping jaws 4, whereby in the starting position such a perpendicular about midway on the slant is directed approximately into the region of the clamping projections *4a*, whereas in the braced position (FIG. 5) although such a line also intersects the space between the two clamping jaws 4, it does so closer to their swivel bearings 5.

For good manipulability the slanting small face 14 continues to the end of the projection 12.

At the end of this slanting small face 14 opposed to the projection 12 there is a slant running in an opposite direction provided in order to somewhat reduce the overall length of the wedge and to ensure that the user delivers the blow is an area of the wedge where it can be transferred well to the clamping jaws 4 via the wedge itself.

At the narrower end of the wedge 7, the wedge 7 also has a small face 15 which is arranged at least in part at an obtuse angle $\beta$ to the one small face *7b* averted from the swivel bearing 5 of the clamp 1 and serves as an impact surface for a striking tool in releasing the clamp 1. The angle of the inclination $\beta$ of the narrower end face of the wedge 7 is selected in such a way that when the clamp 1 is closed a perpendicular on this slanting face is directed approximately to the clamping zone of the clamping jaws 4, so that a good transfer of force for swivelling the clamping jaws 4 is also attained during release. By virtue of the inclination particularly of small face 14, but also of the opposite small face 15, the resolution of force of an applied blow is so good that a single blow may suffice for bracing of for releasing the clamp 1, the striking force being converted into swivelling movement of the clamping jaws 4 considerably more effectively than in the embodiment of FIGS. 1 to 3. This is due to the fact that at the points 6 at which the wedge 7 is applied to the clamp jaws 4, a force component in the direction in which these clamping jaws 4 extend arises which is of substantially greater magnitude than if only the widening of the wedge leads to displacement of this point of application 6. The force component running in the direction of the clamping jaw can swivel the clamping jaw directly under the lever arm relative to the swivel bearing 5. Therefore reaction forces causing vibrations can be prevented to a very large extent.

The clamp 1 serves for formwork panels arranged in-plane, side by side, to be connected at the webs 3 running round their edges and has for this purpose two clamping jaws 4 which urge these edge webs 3 together and can be swivelled relative to each other and to a mount 8 with the aid of a wedge 7, the mount simultaneously constituting the abutment for the wedge 7. The clamping jaws have for this purpose points 6 of application for the wedge face *7c* averted from face *7b*, which points of application are spaced from the swivel bearings 5 of the clamping jaws and are under a lever arm. These points of application 6 are suitably arranged at the inner end of an elongated and guiding slot 10 which is open towards the opposite side and also affords lateral guidance for the wedge as it moves. The direction in which the wedge extends and moves is crosswise to the extent of the swivelling axes of the swivel bearings 5 with which the clamping jaws 4 are swivel-mounted on the common mount 8.

I claim:

1. A claim for connecting formwork panels (2) which are arranged-in-plane, side by side, and have webs (3) or sections running around their edges, the clamp including two clamping jaws (4) which are adapted to be swivelled towards and urge together the longitudinal faces (*3a*) averted from each other of the abutting edge sections or the like, and further including an actuating element for swivelling said clamping jaws (4), the two clamping jaws (4) each having located at their end averted from their clamping point and arranged in spaced relationship to their swivel bearing (5), a point of application (6) for the actuating element, and the actuating element being supported on a mount (8) belonging to the clamp (1), on which the two clamping jaws (4) are swivel-mounted, wherein the actuating element is a wedge (7) which is arranged with its large face (*7a*) in the swivelling plane and is supported with a small face (7*b*) against the mount (8) side facing the forming surface (9) and is supported with the other wedge face (7*c*) against the points of application (6) of the clamping jaws (4), the former being arranged in spaced relationship to the swivel bearings (5), that the points of application (6) of the two clamping jaws (4) are in each case arranged on sides of the swivel bearings (5) averted from each other, and in both end positions of the wedge (7) the latter projects beyond both clamping jaws (4) at their points of application (6).

2. A clamp as claimed in claim 1, wherein the mount (8) is a hollow section and has at least one limb (8*a*) which is arranged parallel to the swivelling plane and serves to accommodate the swivel bearing (5) of the clamping jaws (4), as well as a crossbar (8*b*) which is spaced away from the forming surface (9) and serves as an abutment for the wedge (7).

3. A clamp as claimed in claim 1 wherein the mount is of angular or U-shaped configuration and the one angle side or the crossbar (8*b*) of the U forms the abutment of the wedge.

4. A clamp as claimed in claim 1, wherein the points of application (6) are closer to the abutment (8*b*) than the swivel bearings (5) of the clamping jaws (4).

5. A clamp as claimed in claim 1, wherein the clamping jaws (4) have an angular or approximately U-shaped cross section and externally lap over the mount (8) in the region of their swivel bearing (5) or are externally embraced by the mount (8) of the U-shaped cross section.

6. A clamp as claimed in claim 1, wherein the region of the points of application (6) of the wedge (7) and the clamping jaws (4) extend lengthwise so as to pass beyond their swivel bearings, and have open-ended, elongated slots (10) partly embracing the wedge (7) and small face (7*c*) thereof engaging said slots.

7. A clamp as claimed claim 6, wherein the elongated slots (10) embracing the wedge (7) have a width slightly exceeding the thickness of the wedge and form a lateral guide of the wedge (7), engaging both large faces of said wedge.

8. A clamp as claimed claim 1, wherein the guide slot (10) is of the same length at both clamping jaws (4), and the clamping jaws (4) are arranged at different angles relative to a cross-sectional plane disposed at right angles to the mount and its crossbar, or the crossbar (8*b*) of the mount (8) is situated relative to the forming surface (9) at the angle at which the two tapering, working faces of the wedge (7) are arranged to each other.

9. A clamp as claimed in claim 1, wherein the wedge (7) has at its tapering, narrower end a projection which protrudes beyond the wedge face 7(*c*) and serves as a stop (11) preventing the wedge from being removed from the clamp (1).

10. A clamp as claimed in claim 1, wherein arranged at the wider end of the wedge (7) there is also a projection (12) jutting out transversely of the direction in which the wedge extends, said projection being averted from the forming surface (9).

11. A clamp as claimed claim 1, wherein between the swivel bearings (5), the mount (8) has at its side facing the forming surface (9) an abutment and locating face (13) or stop face for the edges of the edge webs (3) or sections gripped by the clamp (1).

12. A clamp as claimed in claim 1, wherein the small face (14), which is located at the wider wedge end and is arranged crosswise to the longitudinal expanse of the wedge and crosswise to the direction in which the wedge (7) moves as the clamp (1) is braced, runs slantwise in such a way that an acute angle (2) is formed between said small face and the small wedge face (7*b*) averted from the swivel bearings.

13. A clamp as claimed in claim 12, wherein the inclination of the small face (14) and the angle thereof to the small face (7*b*) of the wedge (7) is selected in such a way that a perpendicular through said slope (14) intersects the space between the two clamping jaws (4).

14. A clamp as claimed in claim 13, wherein the slanting small face (14) continues to the end of the projection (12) provided at the wider end of the wedge (7).

15. A clamp as claimed in claim 1, wherein at the narrower end of the wedge (7), the wedge (7) has a small face (15) which is arranged at least in part at an obtuse angle (B) to the small face (7*b*) averted from the swivel bearings (5) of the clamp (1) and serves as an impact surface for a striking tool during release.

16. A clamp as claimed in claim 1, wherein the angle of the inclination (B) of the narrower end face of the wedge (7) is selected in such a way that when the clamp (1) is closed a perpendicular on said slanting face is directed approximately to the clamping zone of the clamping jaws (4).

* * * * *